US006320555B1

(12) United States Patent
Schadler

(10) Patent No.: US 6,320,555 B1
(45) Date of Patent: Nov. 20, 2001

(54) INTERNALLY BRANCH FED SLOTTED COAXIAL ANTENNA

(75) Inventor: John L. Schadler, Raymond, ME (US)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/735,910

(22) Filed: Dec. 14, 2000

(51) Int. Cl.[7] ..... H01Q 13/12
(52) U.S. Cl. ..... 343/791; 343/771
(58) Field of Search ..... 343/791, 790, 343/770, 771, 767, 68, 69

(56) References Cited

U.S. PATENT DOCUMENTS 2,452,767 * 11/1948 Kraus ..... 250/33.65
2,767,397 * 10/1956 Brnye ..... 343/790
3,936,836 * 2/1976 Wheeler et al. ..... 343/771

* cited by examiner

*Primary Examiner*—Don Wong
*Assistant Examiner*—James Clinger
(74) *Attorney, Agent, or Firm*—Pepper Hamilton LLP

(57) ABSTRACT

A slotted coaxial antenna design that accomplishes four-way branch feeding without the use of feedlines, is disclosed. In a preferred embodiment, the antenna design is based on a number of layered coaxial feeds where each layer feeds the next outer layer. The internally branch fed slotted coaxial antenna design produces substantially no beam sway over at least four television channels, can accommodate pressurizing for increased power handling, and provides desirable antenna output response performance suitable for digital TV transmission and NTSC antenna systems.

20 Claims, 7 Drawing Sheets

INTERNALLY BRANCH FED SLOTTED COAXIAL ANTENNA

FIELD OF INVENTION

The present invention generally relates to the field of slotted coaxial antenna designs. More particularly, the present invention relates to the design of a multiple-channel transmitting slotted coaxial antenna that can be internally branch fed without the use of feedlines.

BACKGROUND OF THE INVENTION

The majority of Ultra High Frequency (UHF) antennas used in National Television System Committee (NTSC) antenna systems are slotted coaxial designs. UHF slotted coaxial antennas gained widespread use in NTSC broadcasting because of their above-average performance characteristics; namely, excellent omni-directional azimuth patterns, low wind loads, and smooth null fill.

While the foregoing performance characteristics are also desirable for digital television (DTV) transmission, the more stringent antenna output performance standards of DTV transmission cannot be met with current slotted coaxial antenna designs. At the present stage of antenna development, the antenna output response performance across multiple channels, which was given little consideration in NTSC systems, is now an important parameter for DTV transmission.

For example, for NTSC transmission, the power distribution across a six MHz television channel is concentrated at three basic carrier frequencies; namely, picture, color and aural. Therefore, the performance of the antenna is critical only at these three carrier frequencies.

However, for DTV transmission, the power is equally distributed across a 5.4 MHz frequency span within the 6 MHz channel. Therefore, the antenna's performance is critical across the entire operating band. This means that the antenna's elevation pattern must remain stable (i.e. unchanged) at all frequencies within the channel, and not just at isolated frequencies.

Use of coaxial antennas for DTV transmission is therefore hindered by the fact that slotted coaxial antennas are not suitable for multi-channel applications. This is due in part to the fact that the slots are not broadband radiators. It is also due to the linear "tap off" feed style, which is conventional practice for slotted coaxial antennas.

As shown in Prior Art FIG. 1, slots 2 are cut axially along the outer conductor 4 and fed from one end 6 in a typical feed design of a slotted coaxial antenna. The spacing "X" of all of the slots along the outer conductor 4 is selected to match with the frequency of a particular channel. Thus, this antenna will exhibit a progressive phase taper as the input frequency varies. This progressive phase taper causes the elevation pattern to change with frequency and, thus, limits the useable bandwidth of the antenna.

As in the prior art antenna of FIG. 1, many slotted coaxial antennas are designed to feed the radio frequency (RF) power from the bottom end of the antenna (i.e., end-fed design). Mechanically, end-fed antennas are convenient particularly for antennas mounted on the top of towers. The signal is fed from the bottom and travels toward the top.

Since signals are fed from the bottom traveling toward the top, the end-fed antenna is constructed with a nominal one wavelength spacing between slots at the design frequency. In theory, as the signal moves from one slot to the next upward along the antenna, a 360-degree phase rotation occurs in effect placing each successive slot level in phase. However, in reality, the one wavelength spacing is only obtained precisely at the design frequency. As a consequence, when the signal frequency scans above or below the exact design frequency, the phase rotation changes, causing the beam tilt to vary. The undesirable effect of beam tilt variation is a detrimental impact on antenna output performance response, of major importance for DTV.

Conventional wisdom that the use of panel antennas to solve the NTSC/DTV problem of multi-channel capability is also not a viable solution. Panel antennas are able to operate over a very wide band by using broadband radiators (typically dipoles) in conjunction with branch feeding each individual panel by power dividers and feedlines. However, a major disadvantage of these antennas is their high wind loading. Panel antennas have larger flat surfaces and thus exhibit much higher wind load than slotted coaxial antennas. Moreover, reliability is an issue with panel antennas due to the complexity of the feed systems, which involve numerous feedlines and connections.

A different slotted cylinder feeding design is the center-fed design, where the signal is fed into the middle of the antenna where the feed point is located. Prior Art FIG. 2 illustrates this design, generally used in a side-mount antenna. As shown in FIG. 2, center feeding is accomplished by using an input "T" 8 between the two antenna halves 10. The advantage of center fed antennas is that the signal travels outward from the center in both directions. The resultant phase taper across the entire aperture of the antenna is therefore zero. The beam sway associated with frequency change is thus eliminated.

In a top mount antenna, as shown in Prior Art FIG. 3, center feeding is mechanically more complex. It requires using a tri-axial configuration 12 in the lower half of the antenna. The triax adds to the mechanical complexity because the inner of the coax at the input becomes the inner for the antenna top section, and the outer of the coax at the input becomes the inner for the antenna bottom section.

The onset of DTV has thus complicated the antenna selection decision for broadcasters who must now operate DTV antenna systems simultaneously with their existing NTSC antenna systems. It would be desirable therefore to provide a coaxial antenna for the DTV and NTSC antenna systems that exhibits acceptable signal coverage, minimal tower wind loading and center feeding, even in top mounted antennas.

SUMMARY OF THE INVENTION

The antenna of the present invention satisfies to a great extent the foregoing need for an improved slotted coaxial antenna design.

In one aspect of the invention a slotted coaxial antenna is provided that embeds a feed system within another feed system in a layered fashion. The slotted coaxial antenna design comprises a number of layered coaxial feeds, where each layer feeds the next outer layer, housed in an antenna slotted outer conductor.

The slotted coaxial antenna is defined by two feed points, among other characteristics, for the upper and lower halves of the antenna. The combination of the two feed points with a power split point, which may be disposed in a location between the two feed points, serves to branch feed the antenna as many times as possible because a feed to the first layer travels inside the coax into the next layer and so on. A significant result is an increase in the bandwidth of the slotted coaxial antenna. Other significant results include the four-way internal branch feeding of the coaxial antenna, four-way branch feeding without feedlines, and the ability of this antenna design to hold a stable output response.

It is therefore an object of the present invention to provide an improved slotted coaxial antenna design that holds a stable output response with frequency.

It is also an object of the present invention to provide an improved slotted coaxial antenna design that increases the antenna's bandwidth via branch feeding.

It is also an object of the present invention to provide an improved slotted coaxial antenna design, which when subject to feeding, does not exhibit a progressive phase taper.

It is also an object of the present invention to provide an improved slotted coaxial antenna design that achieves suitable operation over at least four television UHF channels.

It is also an object of the present invention to provide an improved slotted coaxial antenna design that achieves suitable operation over at least four television channels without undesirable or unacceptable levels of beam sway over the same four channels.

It is also an object of the present invention to provide an improved slotted coaxial antenna design that incorporates branch feeding without the use of the feedlines.

It is also an object of the present invention to provide an improved slotted coaxial antenna design which antenna output response performance is suitable for DTV transmission systems as well as NTSC transmission systems.

It is another object of the present invention to provide an improved slotted coaxial antenna design that facilitates the configuration of the DTV and NTSC antenna systems to provide adequate signal coverage while minimizing tower wind loading.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE PREFERRED EMBODIMENTS

DETAILED DESCRIPTION OF PREFERRED EMBODIMENTS

Figure 1:
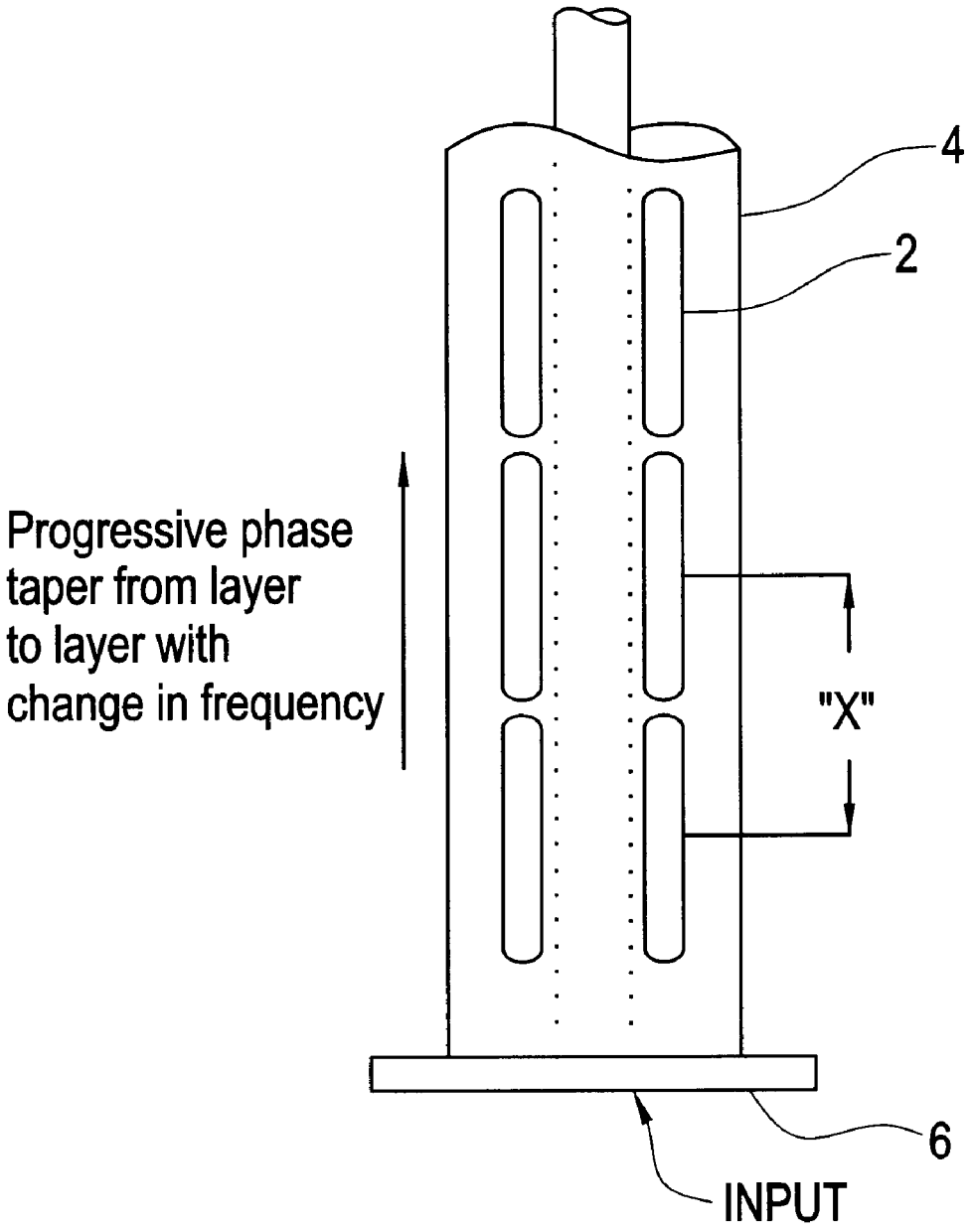
FIG. 1 PRIOR ART
FIG. 1 is a partial side perspective view of a conventional slotted coaxial antenna.
Figure 2:
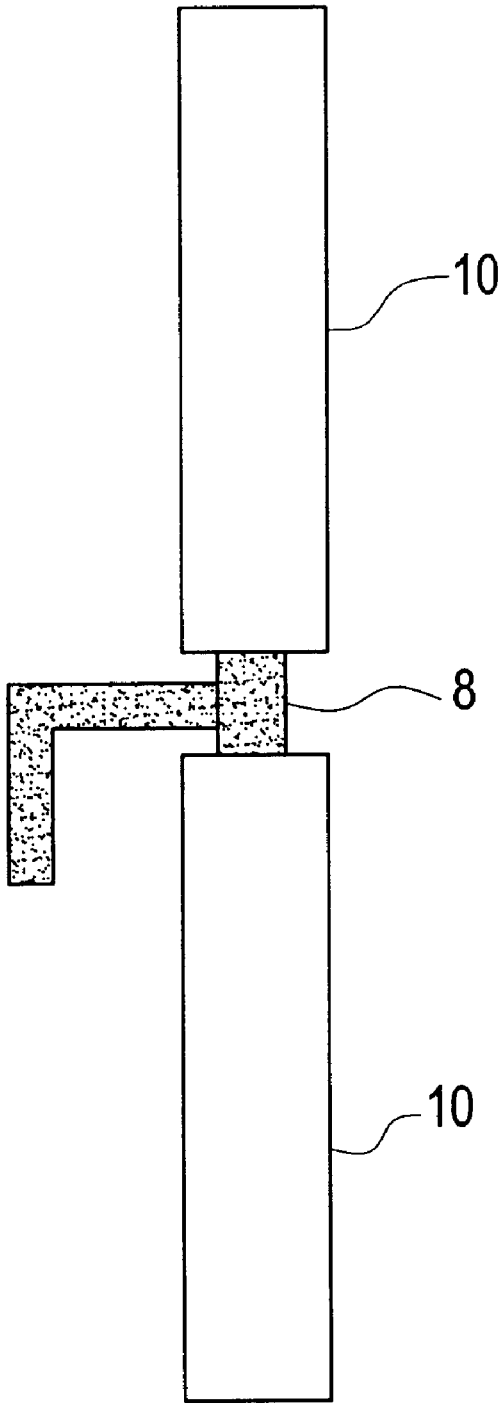
FIG. 2 PRIOR ART
FIG. 2 is a side plan view of a conventional sidemount antenna design.
Figure 3:
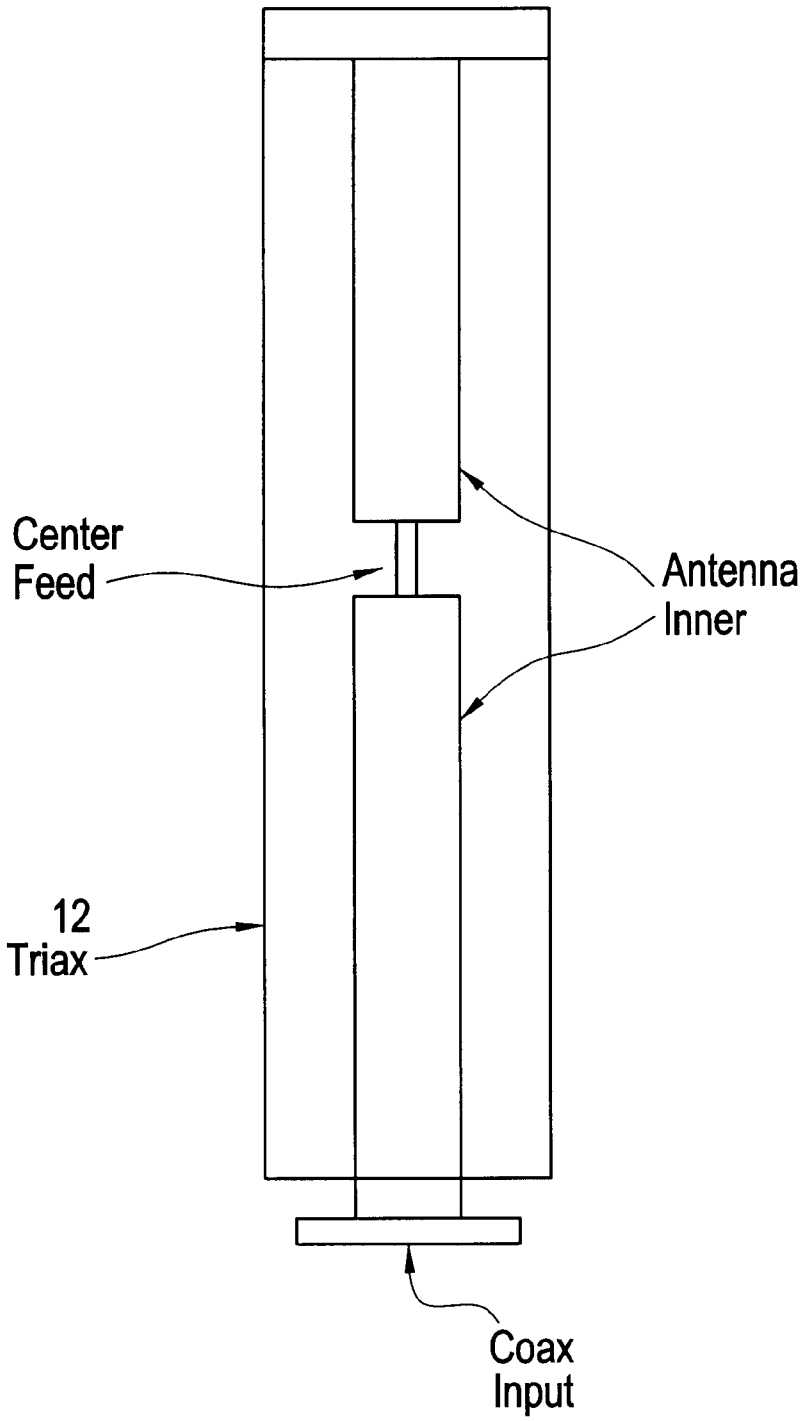
FIG. 3 PRIOR ART
FIG. 3 is a side plan view of a conventional topmount antenna design.
Figure 4:
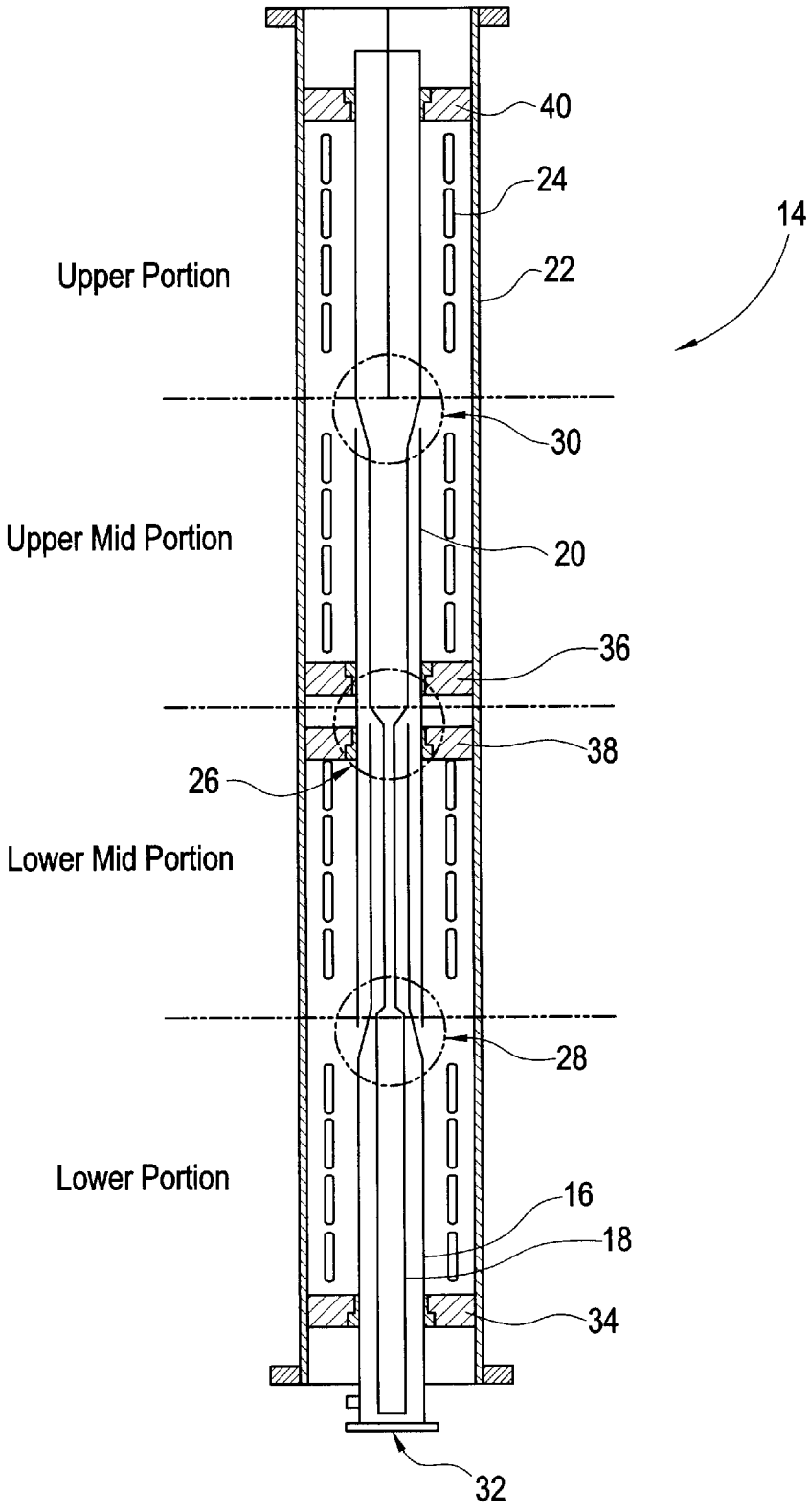
FIG. 4 is a cut away view of a slotted coaxial antenna of a preferred embodiment of the present invention.

Referring now to the figures wherein like reference numerals indicate like elements, in FIG. 4, there is shown, a new four-way branch fed slotted coaxial antenna 14. The four-way branch fed slotted coaxial antenna 14 includes a plurality of inner conductor layers 16, 18 and 20 in a slotted outer conductor layer 22. Each slot 24 is generally equidistant axially from adjacent slots.

There is a feed point at the center 26 and for each of the upper and lower halves of the inner conductor respectively, of the antenna 14, such that the antenna is branch-fed four ways instead of two ways as in conventional antennas. Each inner conductor layer 16, 18 and 20 feeds the adjacent layer. All inner conductor layers 16, 18, and 20 are internal to the outer conductor layer 22 with the outermost inner layer 20 acting as the inner conductor of the antenna 14 in the upper and lower mid-portions. In the upper portion, the inner most conductor layer 18 acts as the inner conductor for the antenna, and in the lower portion the middle conductor layer 16 acts as the inner conductor for the antenna. That is, this is a feed system embedded inside another feed system.

The first power split point 26 splits the signal up and down, defining upper and lower portions of the antenna. The feed points 28, 30 further split the upper and lower portions of the antenna 14.

The antenna further comprises an antenna input 32, which consists of coaxial outer conductor layer 16, and inner conductor layer 18. The signal feed going into antenna input 32 is the physical input connection. The signal coming in from antenna input 32 travels up to power split point 26 and splits in half, with a portion of the signal traveling above split point 26 between inner conductor layer 18 and outer conductor layer 20, and another portion of the signal traveling below split point 26 between inner conductor layer 16 and outer conductor layer 20.

At the point of the first power split 26, the inner layer 18 of the antenna input is the inner for the energy traveling upward, via the upper mid portion, from the first power split point 26. Similarly, the outer 16 of the antenna input becomes the inner conductor for the energy traveling downward, via the lower mid portion, from the first power split point 26. The outermost inner layer 20 facilitates the flow of energy traveling upward and downward, via the upper and lower mid portions respectively, of the first power split point 26.

In accordance with one aspect of the present invention, the antenna power is further split at feed point 30 to feed the upper portion of the antenna 14. At this juncture, the inner conductor layer 18 for the upward traveling energy from the first power split point 26 becomes the inner conductor for the upper portion of the antenna 14. In addition, at feed point 30, layer 20 becomes the inner conductor for the upper mid portion of the antenna 14.

To feed the lower portion of the antenna 14, power is split at feed point 28. The inner layer for the upward traveling energy feeding the lower mid portion of the antenna is element 20. And the middle layer 16 of the antenna input 32 is now the inner conductor for the downward traveling energy feeding the lower portion of the antenna.

The bottom 34, located adjacent the antenna input 32, defines the bottom short for the lower half of the antenna. The other bottom 36, located adjacent the top 38, defines the bottom short for the upper half of the antenna 14.

Similarly, the top 40, distally located from the antenna input 32, defines the top short for the upper half of the antenna 14, whereas the top 38 defines the top short for the lower half of the antenna 14.

Figure 5:
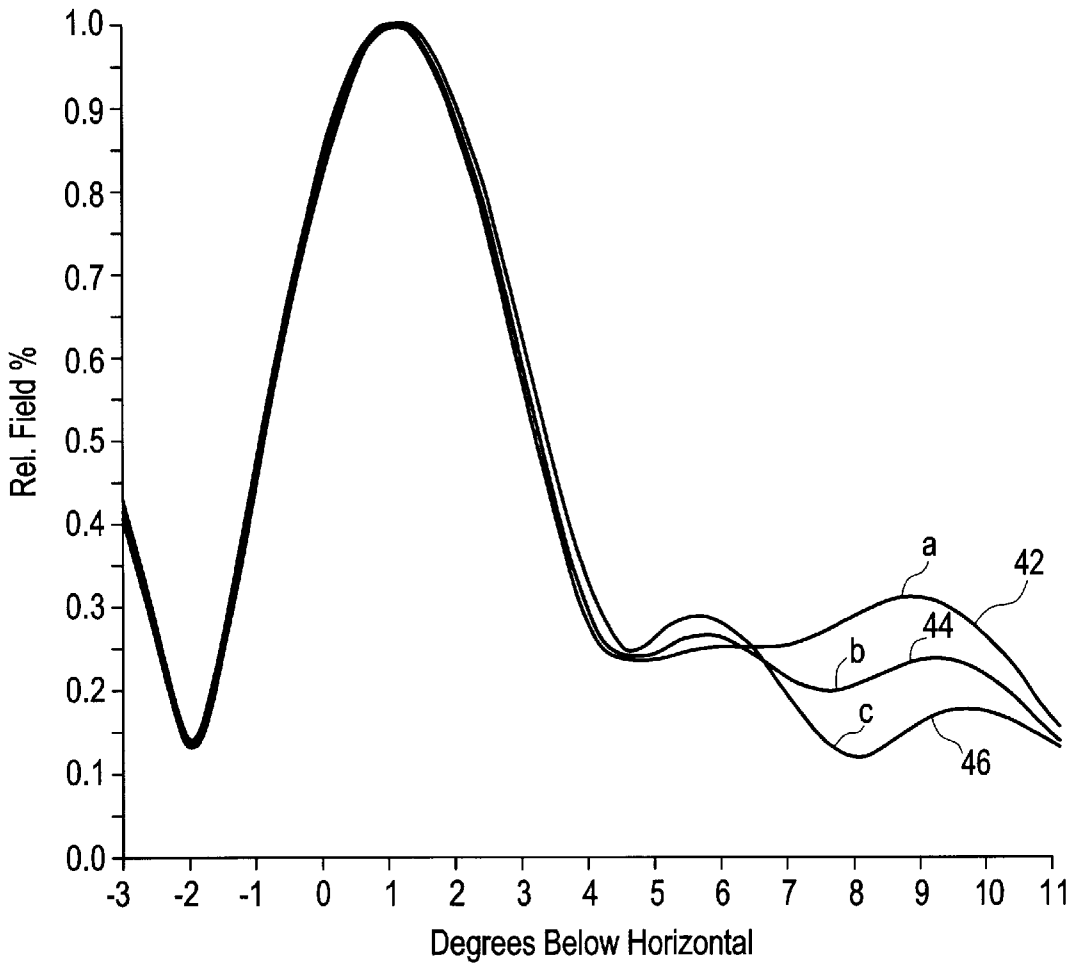
FIG. 5 is a graph depicting the calculated elevation patterns for the antenna of FIG. 4 across 24 MHz at the center of a UHF band.

Calculations of the elevation patterns for an internally branch fed slotted coaxial antenna, such as the 16 layer slotted coaxial antenna shown in FIG. 4, show that suitable operation is achieved over at least four television UHF channels (24 MHz) 42, 44, 46, as shown by the graph of FIG. 5. The graph shows a desirable beam sway of zero degrees between all three channels 42, 44, 46. This pattern contrasts with the illustration in FIG. 6, which shows an undesirable beam sway of 2.2 degrees for a conventional end-fed slotted coaxial antenna.

When utilized in television transmission, the antenna of the present invention provides strong signal power over four 6 MHz televisions channels (as compared to prior art antennas that typically provide two channels, because the power from the antenna of the present invention remains stable across a 24 mHz band).

Figure 6:
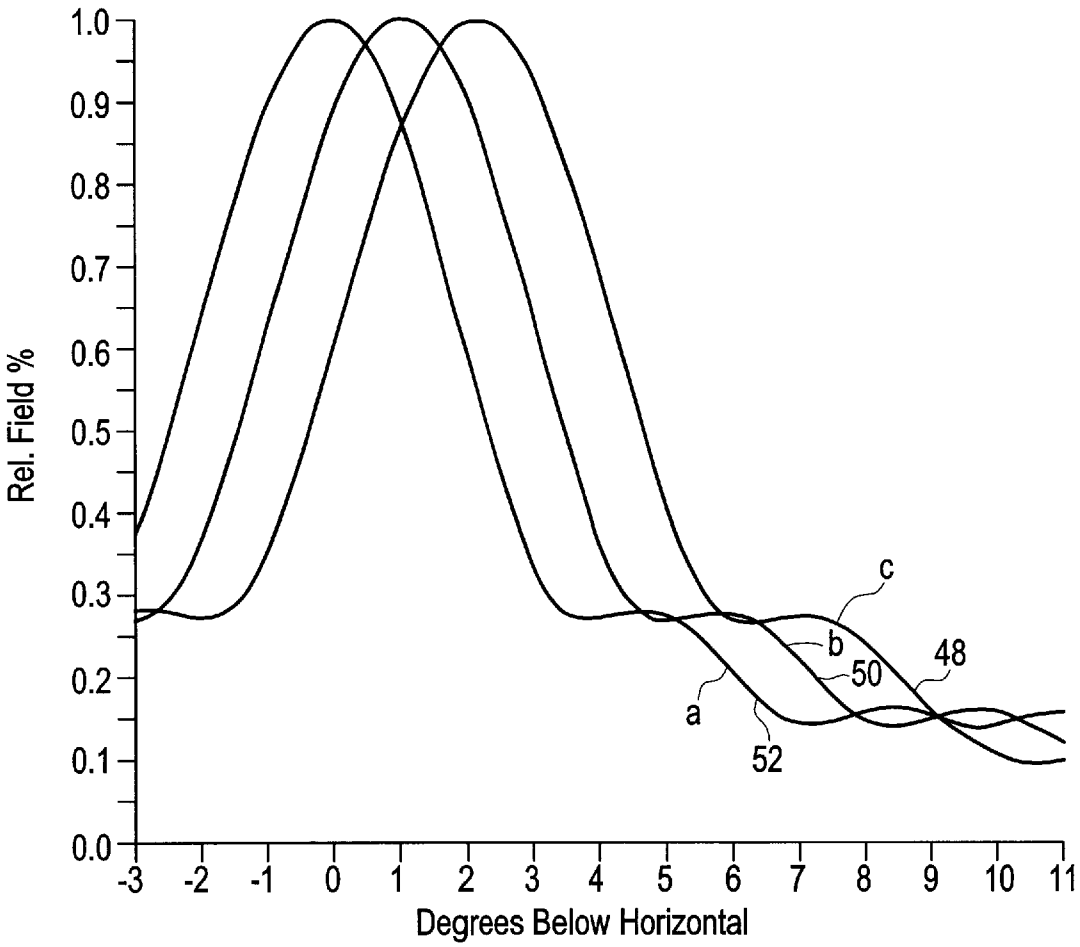
FIG. 6 is a graph depicting the calculated elevation patterns of a conventional end-fed slotted coaxial antenna across 24 MHz at the center of a UHF band.

Referring now to FIG. 6, it can be seen that lines 48, 50 and 52 do not share the same peak. Lines a, b and c are each off-set from each other by approximately 2.2 degrees, hence a beam sway of the same value. This means that power from the antenna of FIG. 6 is not stable across the 24 mHz band. Consequently, a viewer watching channel 36, for instance, will not receive the same signal strength when viewing channel 38, or channel 40. In this regard, acceptable operation across these channels is not achieved.

More specifically, the plotting in FIGS. 5 and 6 shows measured relative field strength of antenna power, in percentages, along the Y-axis versus degrees from horizontal along the X-axis. For instance, the peak shown at 1.0 degrees below horizontal corresponds to 100 percent of the relative field in the antenna. For the X-axis, zero degrees corresponds to a position exactly perpendicular to the antenna. Consequently, one, two or three degrees correspond to one, two or three degrees below the horizontal position of the antenna.

One important aspect of the present invention shown by FIG. 5 is the absence of beam sway over the same three television UHF channels depicted in FIG. 6.

More specifically, the absence of beam sway is evidenced by the congruence of each of the three elevation patterns identified as lines 42, 44 and 46 of FIG. 5 into a substantially singular bell-shaped curve in the vicinity of the curve's peak at one degree below the horizontal, plus or minus two degrees. In other words, the peak of lines 42, 44 and 46, across the 24 mHz band, covering all four television channels, lies in substantially the same spot.

Another important aspect of the present invention shown by FIG. 5 is the fact that acceptable operation is achieved over four TV channels for instance, each line 44, 46 and 48 represents a UHF channel. Line 44, the middle line, represents a center of a 24 MHz band by which four channels can be occupied (i.e. 629 MHz). The lower line 46 represents the relative antenna field strength at the lowest frequency of the 4-channel spread (i.e. at 617 MHz). Finally, the top line 42 represents channel the highest frequency of the 4-channel spread (i.e. at 641 MHz).

The significance of the above to a viewer watching television is that the viewer will receive the same signal strength across four adjacent channels because the power from the antenna of the present invention, remains stable across the 24 mHz band.

Figure 7:
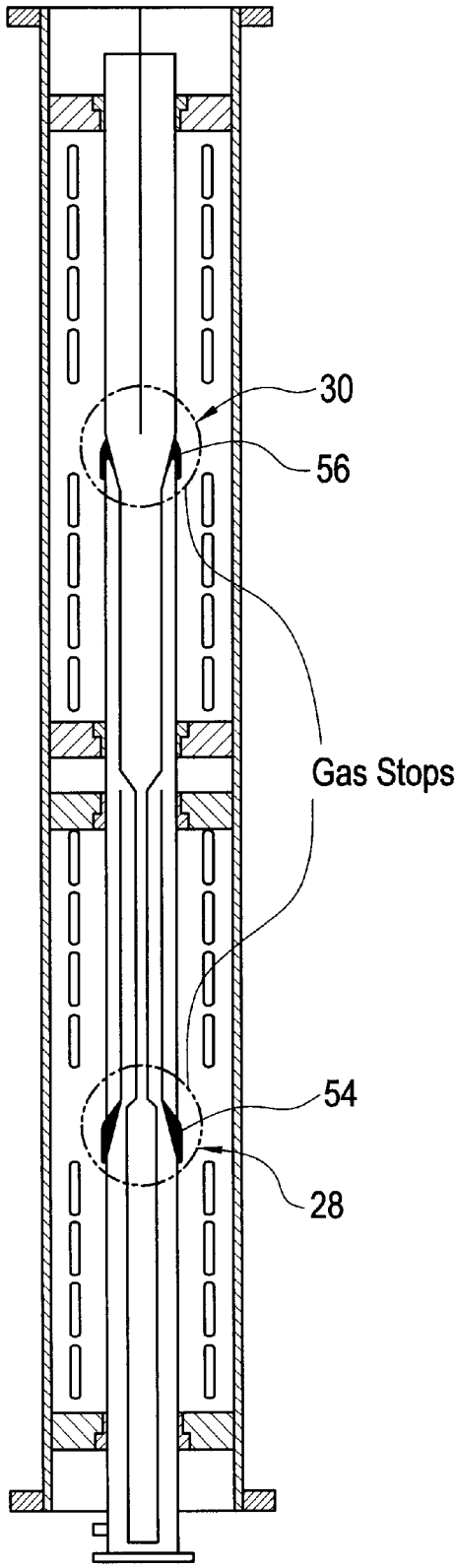
FIG. 7 is a cutaway view of a slotted coaxial antenna in accordance with a second preferred embodiment.

In another aspect of the present invention, higher power handling can be achieved by pressurizing the feed system. That is, gas stops 54, 56 can be advantageously located at feed points 28, 30, respectively, as shown in FIG. 7.

It is now apparent that the antenna system design of the present invention has a number of features and advantages over the prior art, particularly in respect to increased broadband bandwidth capabilities, stable frequency response, no beam sway, acceptable levels of operation over at least four television channels, branch feeding without the use of feedlines, improved antenna output response performance suitable for both digital TV transmission systems and NTSC antenna systems, etc.

While the invention has been described in terms of various preferred embodiments, those skilled in the art will recognize that the many features and advantages of the invention are apparent from the detailed specification, and that various modifications, substitutions, omissions and changes can be made without departing from the spirit of the present invention.

For example, one embodiment using a 16-layer slotted coaxial antenna that is 4-way branch fed, is exemplary. Other embodiments employing a number of layers having a factor of four, because of the 4-way branch design, fall within the spirit of the present invention.

Similarly, the 16-layer slotted coaxial antenna can be shown as an 8-layer antenna with each branch feeding two layers. Alternatively and optionally, the 16-layer slotted coaxial antenna can also be shown as a 32-layer antenna with each branch feeding 8 layers. The concept of the present invention is not limited to 16 layers, nor is it limited to a 4-way branch feed.

Accordingly, it is intended that all suitable modifications and equivalents may be resorted to as falling within the scope of the invention.

What is claimed is:

1. A slotted coaxial antenna having layered coaxial feeds, said antenna comprising:

(a) a plurality of inner conductor layers in a slotted outer conductor layer;

(b) two feed points spatially located along said inner conductor layers, to split out signals; and (c) a first power split disposed substantially intermediate of said two feed points, to hold frequency response stable.

2. The slotted coaxial antenna according to claim 1, further including an antenna input comprising a coaxial outer conductor layer and an inner conductor layer.

3. The slotted coaxial antenna according to claim 1, wherein groups of slots are branch fed without the use of feedlines.

4. The slotted coaxial antenna according to claim 1, wherein said antenna is branch-fed four ways, feeding an upper portion, lower portion, upper mid portion and lower mid portion of said antenna.

5. The slotted coaxial antenna according to claim 1, which exhibits a beam sway of substantially zero degrees.

6. The slotted coaxial antenna according to claim 1, further comprising a gas stop, disposed at each feed point, for pressurizing purposes.

7. The slotted coaxial antenna according to claim 1, further providing suitable signal power over at least four 6 MHz television channels.

8. A slotted coaxial antenna having layered coaxial feeds, said antenna comprising:

plurality of inner conducting means, within a slotted outer conductor means, for transmitting signals;

two feed means, spatially located along said inner conducting means, for splitting out said signals; and power splitting means, disposed substantially intermediate of said two feed means, for holding a frequency response of said antenna stable.

9. The slotted coaxial antenna according to claim 1, wherein groups of slots are branch fed without the use of feedlines.

10. The slotted coaxial antenna according to claim 1, wherein said antenna is branch-fed four ways, feed an upper portion, lower portion, upper mid portion and lower mid portion of said antenna.

11. The slotted coaxial antenna according to claim 1, having a beam sway of substantially zero degrees.

12. The slotted coaxial antenna accordingto claim 1, further comprising:

a gas stop, disposed at each feed point, for pressurization within said slotted coaxial antenna.

13. The slotted coaxial antenna according to claim 1, wherein said antenna sustains signal power over at least four 6 MHz television channels.

14. A methof of transmitting signals, comprising:

transmitting the signals to a slotted coaxial antenna; and radiating the signals from said slotted coaxial antenna, wherein said slotted coaxial antenna has a plurality of inner conductor layers located within outer conductor layer, two feed points spatially located along said inner conductor layers for splitting out said signals, and a first power split means disposed substantially intermediate of said two feed points for holding a frequency response to said slotted coaxial antenna stable.

15. The method according to claim 14, wherein said slotted coaxial antenna has a plurality of slots.

16. The method according to claim 15, wherein said plurality of slots is branch fed without the use of feedlines.

17. The method according to claim 14, further comprising:

branch feed system that feeds an upper portion, a lower portion, an upper mid portion and a lower mid portion of said slotted coaxial antenna.

18. The method according to claim 14, wherein said signals are at least one of DTV and NTSC signals.

19. The method according to claim 14, further comprising:

a gas stop disposed at each of said two feed points.

20. The method according to claim 14, wherein said slotted coaxial antenna sustains signal power over at least four 6 MHz television channels.

* * * * *